US005348510A

United States Patent [19]

DuPont et al.

[11] Patent Number: 5,348,510

[45] Date of Patent: Sep. 20, 1994

[54] TOY WITH FANCIFUL INTRA-CHANGEABLE PARTS

[75] Inventors: Paul DuPont; Brian W. Grosvenor, both of Malden, Mass.

[73] Assignee: Hatsoff? Development, Inc., Malden, Mass.

[21] Appl. No.: 816

[22] Filed: Jan. 5, 1993

Related U.S. Application Data

[63] Continuation of Ser. No. 686,249, Apr. 16, 1991, abandoned.

[51] Int. Cl.[5] ..... A63H 3/16; A42B 1/24

[52] U.S. Cl. ..... 446/100; 446/27; 446/327; 446/901; 2/209.12; 2/209.13; 2/918

[58] Field of Search ..... 446/27, 100, 372, 391, 446/321, 320, 369, 901; 2/199, 186, 185 R

[56] References Cited

U.S. PATENT DOCUMENTS

| | | | |
|---|---|---|---|
| 4,208,832 | 6/1980 | Corrivean | 446/100 |
| 4,268,918 | 5/1981 | Lee | 446/27 X |
| 4,504,240 | 3/1985 | Thomas | 446/100 |
| 4,648,851 | 3/1987 | Rosenberg | 446/372 |
| 4,883,441 | 11/1989 | Byer | 446/901 X |
| 4,964,832 | 10/1990 | Bickoff | 446/901 X |
| 4,979,924 | 12/1990 | Manger | 446/100 |
| 5,178,574 | 1/1993 | Evoy | 446/372 |

*Primary Examiner*—Mickey Yu

*Attorney, Agent, or Firm*—Hayes, Soloway, Hennessey, Grossman & Hage

[57] ABSTRACT

A toy hat, mask, puppet or the like on which fanciful animal, human or monster faces can be created by attaching discrete facial elements comprised of a nose, eyes, ears, cheeks and the like. They are made, in whole or part, from fabric materials of a "loop" fastening nature, which with selective parts may be transformed (intra-changed) to make different styled nose, ear, tongue, eyebrow and the like. These discrete formable parts along with the other inter-changeable parts may then be mounted to the "hook" fastening composite materials of the curved compound surface located in the area of the face, forehead and front scalp region of the toy and other like items. At least 50% of the area of this curved compound composite surface is covered by a "hook" material layer made up of an essentially non-extensively flexible "hook" of a woven and/or extruded product. The non-extensible sections are positioned such that they cover no greater area than about 15 degrees of arc of the compound surface of the forehead and front scalp.

5 Claims, 9 Drawing Sheets

TOY WITH FANCIFUL INTRA-CHANGEABLE PARTS

This is a continuation of copending application Ser. No. 07/686,249 filed on Apr. 16, 1991, abandoned.

This invention pertains to toys and more particularly to toy hats, masks and puppets and/or like items having a plurality of intra-changeable, as well as inter-changeable, facial parts. These parts are securable to the hat, mask and puppet and/or like items so as to represent the head/face of a fanciful animal, human or monster character.

BACKGROUND OF THE INVENTION

Frequently, conventional hats are embellished with ornamentation to make the hat more stylish, fanciful, eye-catching, or otherwise appealing. Such ornamentation includes selected fabrics, feathers, beads and graphics.

Often, such hats are constructed to allow the user to modify the appearances of the hat by repositioning the ornamental elements provided thereon. For instance, a hat embellished with feathers may be constructed to allow the appearance thereof to be modified by selected repositioning of the feathers.

Hats are known on which toy stuffed animals or birds are permanently secured to the outer surface of the hat. Such hats are typically considered to be a toy or fanciful head decoration rather than conventional ornamented headwear.

Toys are known which include a plurality of facial parts that can be arranged in unique combination to represent the head of a creature or character. One such toy, known as Mr. Potato Head (R), consists of a plurality of different hard plastic ears, noses, mouths, eyes and other parts that can be inserted into a potato in unique combination so as to define an original creature. Another such toy is a puppet with movable rubber and hard plastic parts that are made to represent individual "specific" facial and body features. These feature specific parts are attached to a puppet body, generally made of compatible "loop" material, by use of a small non-extensible strip of a Velcro (R) "hook" material which is connected to each individual elemental part.

BRIEF DESCRIPTION OF THE INVENTION

The present invention comprises a base support, such as a hat, mask, puppet or the like item on which a fanciful animal, human and monster faces can be created by attaching discrete intra-changeable, as well as interchangeable, elements that form noses, beaks, eyes, ears, tongues, horns, cheeks, and the like that are made, in whole or in part, of soft foam/laminated "loop" fabric materials. The base support preferably includes a face, forehead and front scalp portion encompassing a compound curved surface having a support layer with a predetermined radius of curvature. An essentially non-extensible "flexible hook" material layer, constituting the discrete "hook" portion of a "hook & loop" fastener system, Velcro (R) or the like "hook" materials, is bonded to this base support layer. Each discrete "hook" portion has at least one non-extensible section which preferably subtends no more than about 15 degrees of arc of the compound surface. At least 50% of the area of the compound surface is preferably covered by the "hook" materials.

Another prime feature of the invention is the use of novel face parts (e.g. nose, ear, beak, cheek, lip, eyebrow, tongue, etc.) which can be reformed so that a single part can provide a completely different type of nose or be made into an ear, eyebrow, tongue, etc. These user shaped facial parts are preferably comprised of a double layer of soft foam/laminated "loop" fastener fabric materials having outer surfaces which are secured together only at the edges and which can be shaped by the user's fingers to provide different styles and types of physical curved forms and facial elements. The thus formed individual shapes can be secured to the "hook" fasteners that are mounted on the fabric of the curved base surface of the hat, mask, puppet and/or like items that hold the shaped (ear, beak, cheek, nose, eyebrow, etc.) forms created by the user. Thus, any outer surfaces of these (de)formable parts, being made of the above noted "loop" fabric, can be secured firmly, at any angle, to any "hook" surface on the hat, mask, puppet and/or like items.

DETAILED DESCRIPTION OF THE INVENTION

BRIEF DESCRIPTION OF THE DRAWINGS

Reference should now be had to the following detailed description of the invention taken in connection with the accompanying drawings wherein.

The hook fastener elements of this toy are preferably formed of a woven or extruded plastic material which provides a number of "hooks" protruding from one surface of a woven or extruded plastic base. A preferred type of hook fastener sheet is that sold by the Velcro Corporation under the designation "Hook 65". This "hook" material has excellent strength and its adhesion to a "loop" type fabric of the individual parts can be subjected to much use and disabuse without losing its ability to securely hold the "loop" fabric of the parts pressed into contact therewith. However, the "hook" material has the disadvantage that it is non-extensible. Thus, while the product is flexible, it can only be flexed around a single axis at a single time.

Since the puppets, hats, masks, and the like items are the base supports to be decorated with fanciful animal, human or monster faces, all having a compound curved skull component, it is necessary to provide a means for attaching the non-extensible Velcro (R) or similar type "hook" layer to this compound curved surface.

Figure 2A:
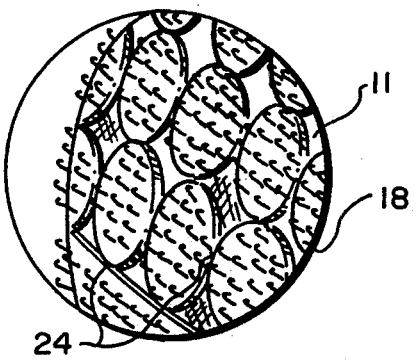
FIGS. 2A and 2B are closeup views showing a portion of the arrangement of the non-extensible discrete pieces of hook fastener elements secured to the compound curved surface representing the forehead of the puppet, hat, mask or like items.
Figure 2B:
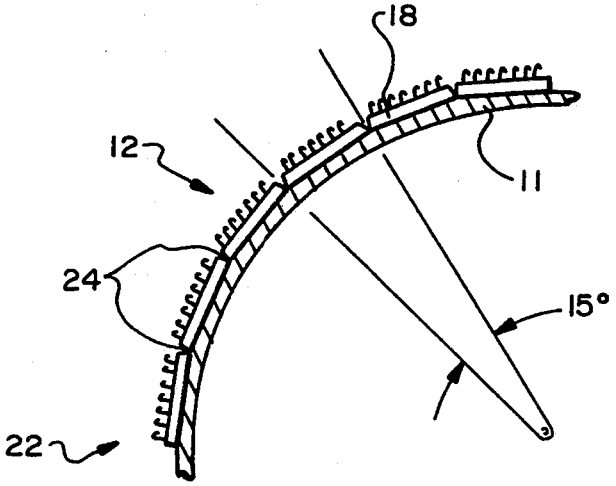
Figure 3:
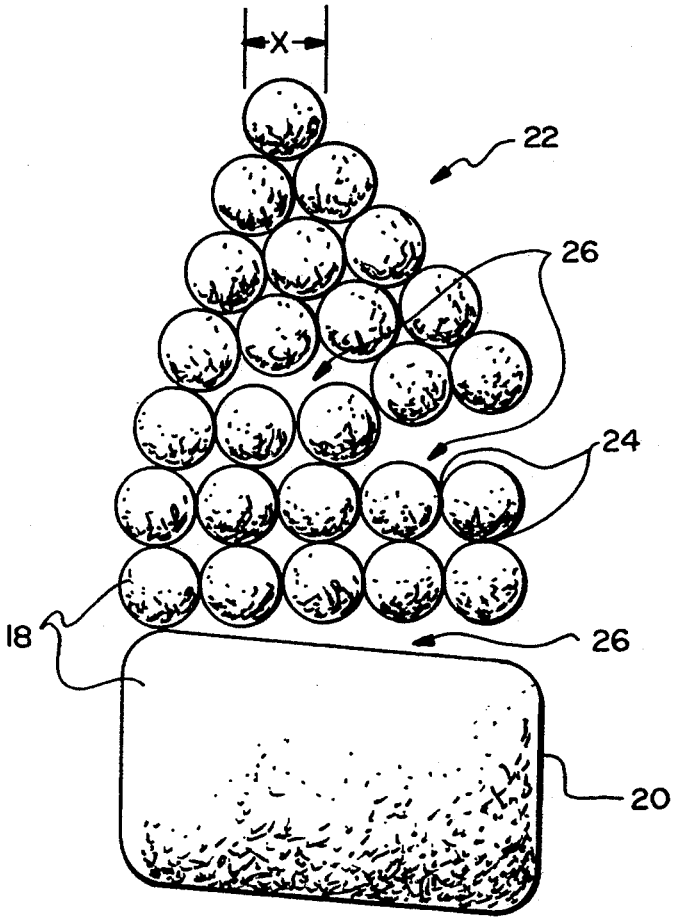
FIG. 3 shows one preferred sample embodiment of the invention showing a die cut sheet of "hook" fastener material prior to being bonded to the compound surface of the base support fabric material of the puppet, hat, mask or like items.

As can be seen in (FIGS. 1, 2A, 2B and 3), the relatively rigid compound curved surface (12) is formed of a layer (11) of stiff open-mesh fabric, which can be of a foam/laminated or a sized material that has been sewn and/or heat set to the shape illustrated. The "hook" layer (18), having upstanding hooks, is die cut as shown in FIG. 3 to give discrete sections (22) formed of circles (preferably) or like shapes, connected at tangent points by narrow bridges (24). Openings (26) are cut at various points to permit movement of groups of dots (circles or like shapes) (22) with respect to each other to cover the compound curve. The larger piece of "hook" material (20) is provided at the bottom of the forehead, in the face area, where there is only a single axis of curvature to provide the maximum amount of exposed "hook". This area could also be made up of dots, circles or like shapes. Each discrete dot, circle or like shape has one dimension "x" of the non-extensible material which subtends no more than about 15 degree of arc of the compound surface. Thus, as seen in (FIGS. 2A and 2B), the dots, circles or like shapes (18), even though not bent, do not interrupt the curve of the compound surface base.

Figure 1A:
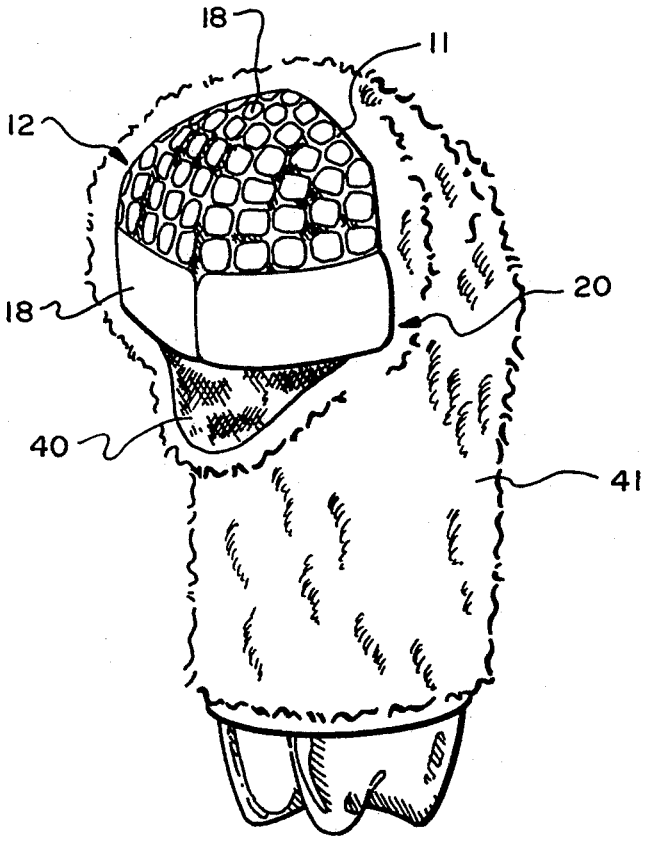
FIG. 1A is a ¾ perspective view of a hand held puppet showing the "hook" surface which is to receive the "loop" pieces constituting the facial elements; eyes, nose, cheeks, ears, tongue, eyebrows, etc. of these fanciful figures as it might be displayed on its' unique (2-liter soda bottle) support base.
Figure 1B:
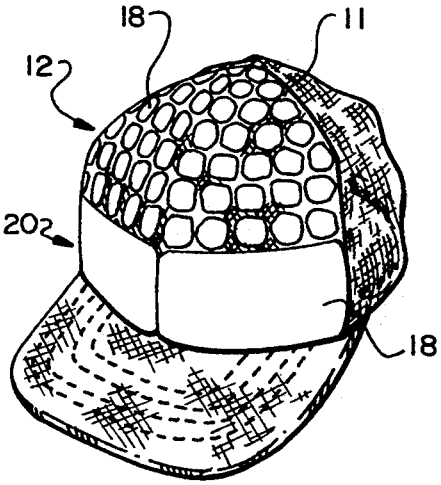
FIG. 1B is a ¾ perspective view similar to FIG. 1A showing the invention as it is applied to a hat (baseball cap) support.
Figure 1C:
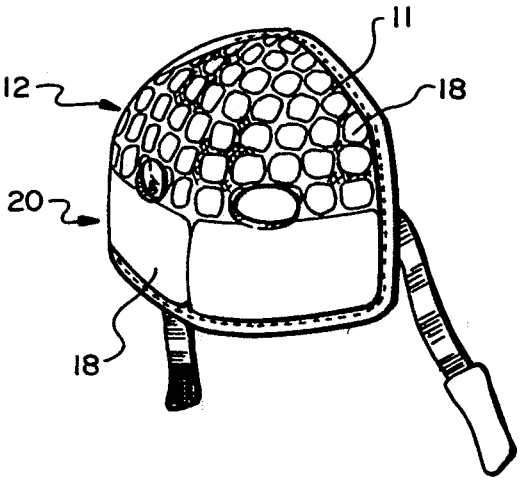
FIG. 1C is a ¾ perspective view similar to the above mention FIGS. 1A & 1B exhibiting the invention as implemented on a mask support.

In FIG. 1A, a modification of the invention, as applied to a puppet, is illustrated where the forehead, front scalp, and face composite surface portions are similar to those of FIG. 1B and 1C. The puppet of FIG. 1A also has a mouth (40) made of foam/laminated cloth, and a neck portion, the base support (41), made of synthetic plush fur fabric and/or cloth fabric materials.

Figure 4B:
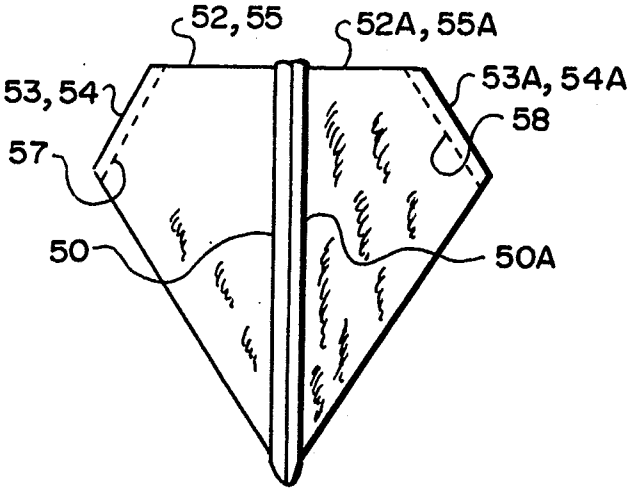
FIGS. 4A through 4J shows one facial part, a nose (4D) that can be given a number of different shapes through user hand & finger manipulation of the parts fabric structure to form a bird beak (4E), nose (4F), nose (4G), ear (4H), bird beak (4I), cheek (4J), etc.
Figure 4C:
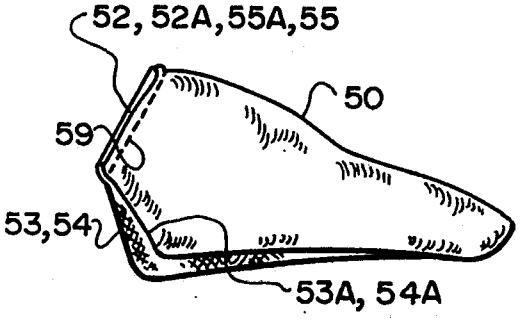
Figure 4A:
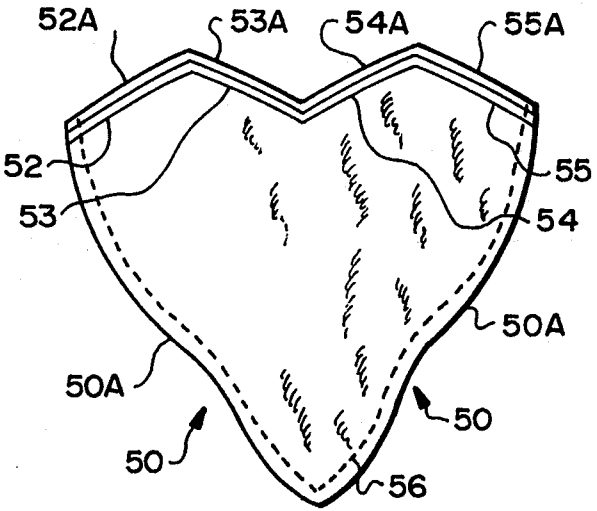
Figure 4D:
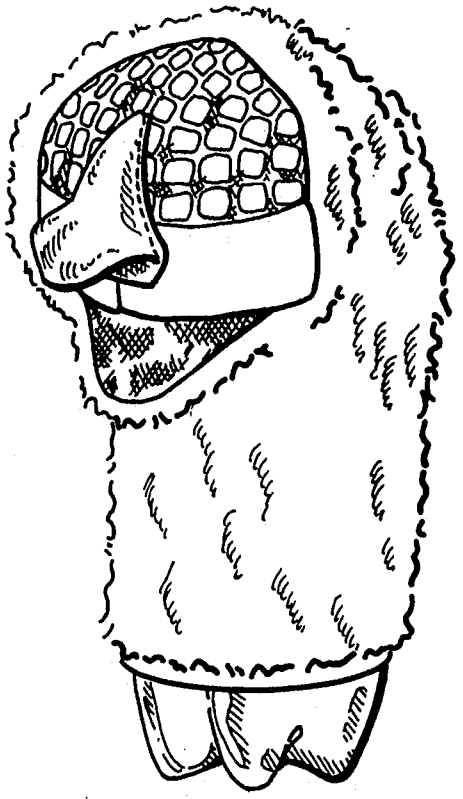
Figure 4E:
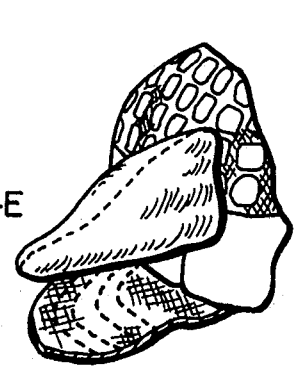
Figure 4F:
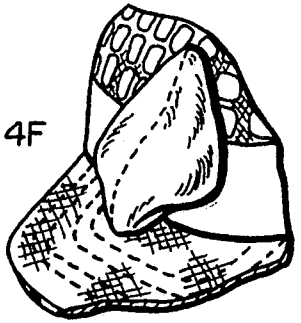
Figure 4G:
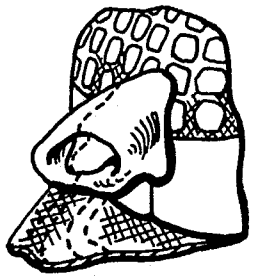
Figure 4H:
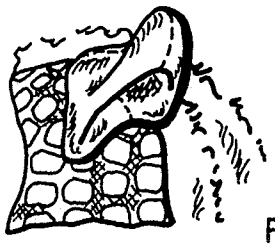
Figure 4I:
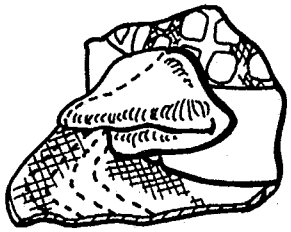
Figure 4J:
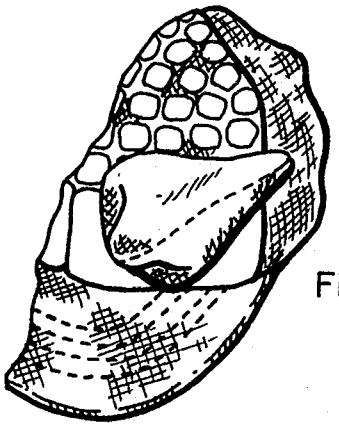

Referring now to FIG. 4A through 4J, one example of an intra-changeable part is illustrated. In FIG. 4A, there is shown a die cut shape of a soft foam laminated loop fabric section. In its preferred embodiment, this fabric is known as "Tempo" or the like Velcro (R) compatible loop materials. Two curved edge surfaces (50) define the long dimension of the part and the more or less straight edged surfaces (52 and 54) define the height of the part. Two identical pieces of this shape, with loop fabric material placed inwardly (face-to-face), are sewn or ultrasonically welded along the broken lines illustrated (56). The two stitched pieces of this part are then pulled apart so that the straight edges (53 & 54) and (53A & 54A) can now be sewn or ultrasonically welded together along broken lines (57 & 58) as shown in FIG. 4B. Thereafter, the part is turned inside out so that the loop of the fabric is exposed outwardly. The exposed loop fabric is then folded in on itself so that edges come together side-by-side in the following order (52/52A/55A/55). It is then sewn or ultrasonically welded along broken line (59) as shown in FIG. 4C. This part can then be used as shown in FIG. 4E or in a modified shape as shown and identified in FIGS. 4J, wherein the shaped part created is retained when it is securely attached by its "loop" fabric to the "hook" fasteners on the composite surface of the puppet, hat, mask, or the like item.

Figure 5A:
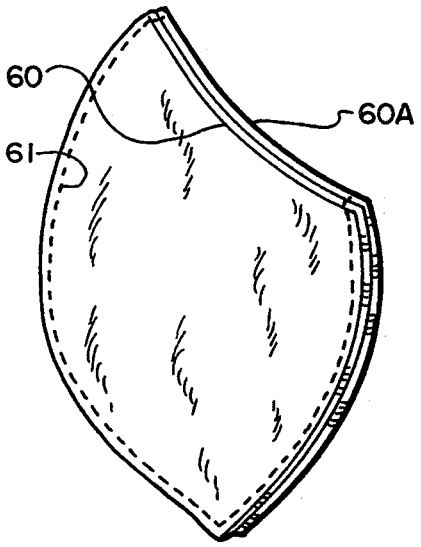
FIGS. 5A through 5H shows another type of facial part shape shown as an ear (5B) which can also be formed into a nose (5C), bird beak (5D), nose (5E), ear (5F), tongue (5G), eyebrow (5H), etc.
Figure 5B:
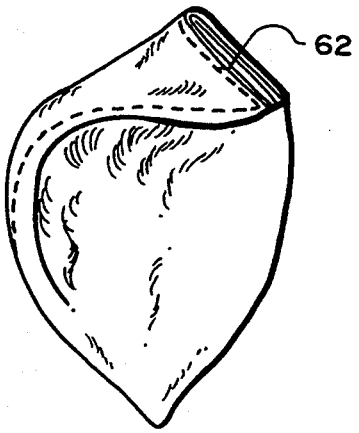
Figure 5D:
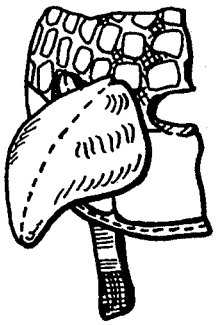
Figure 5C:
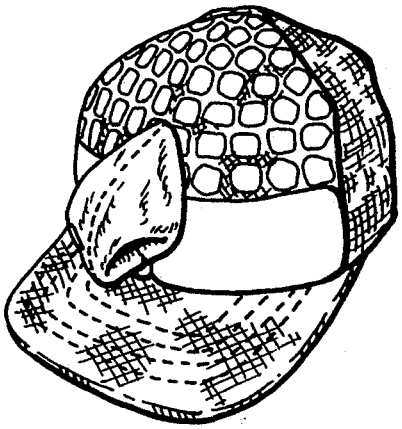
Figure 5H:
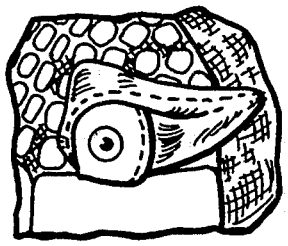
Figure 5E:
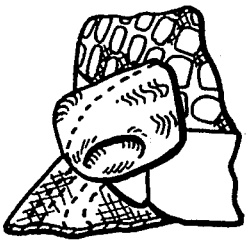
Figure 5F:
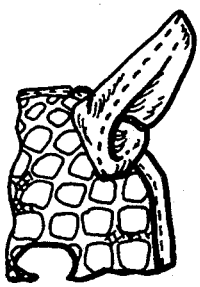
Figure 5G:
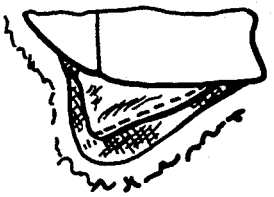
Figure 6A:
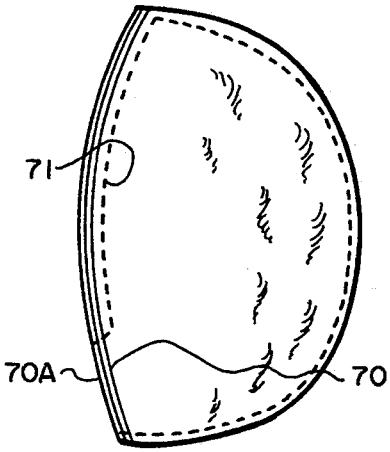
FIGS. 6A through 6J shows yet another unique facial part shaped as a nose (6C) which can also be formed into a bird beak (6D), ear (6E), lip (6F), beak (6G), nose (6H), cheek (6I), nose (6J), etc.
Figure 6B:
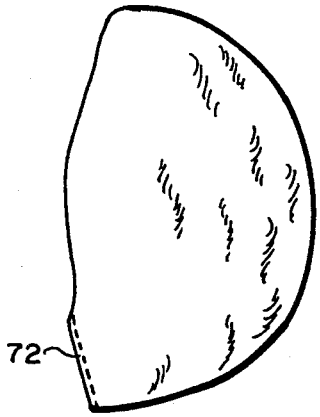
Figure 6D:
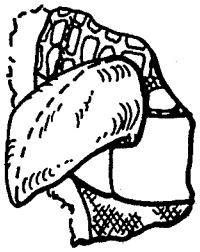
Figure 6C:
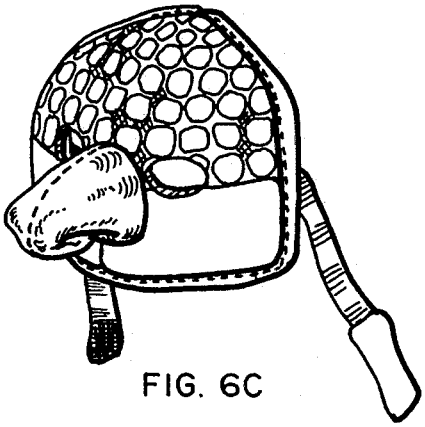
Figure 6J:
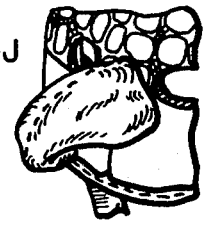
Figure 6I:
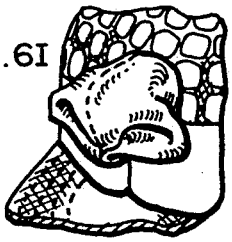
Figure 6E:
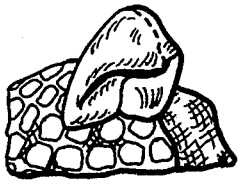
Figure 6F:
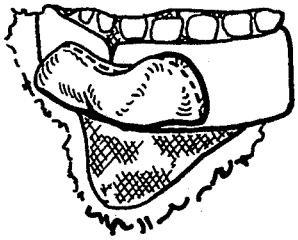
Figure 6G:
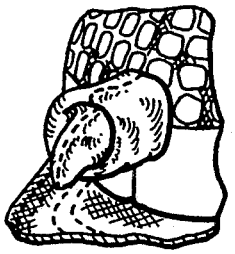
Figure 6H:
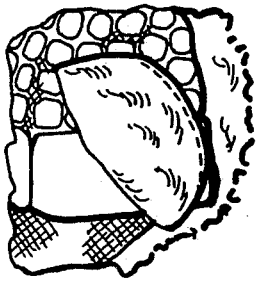
Figure 7A:
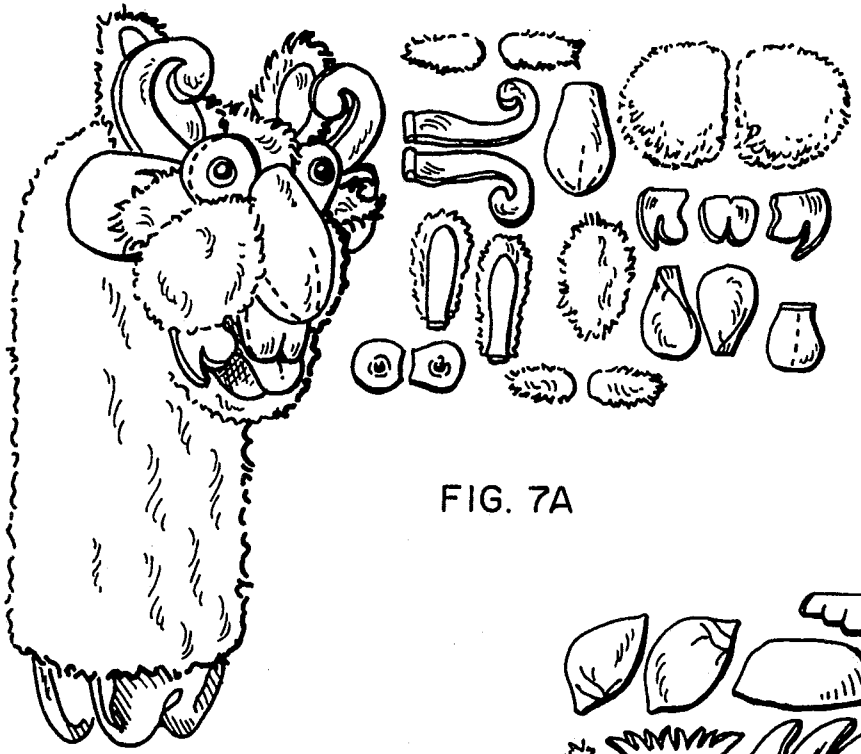
FIGS. 7A through 7D show a puppet with a number of facial elements which can be applied to the face, forehead and front scalp surface containing the "hook" fastener materials.
Figure 7B:
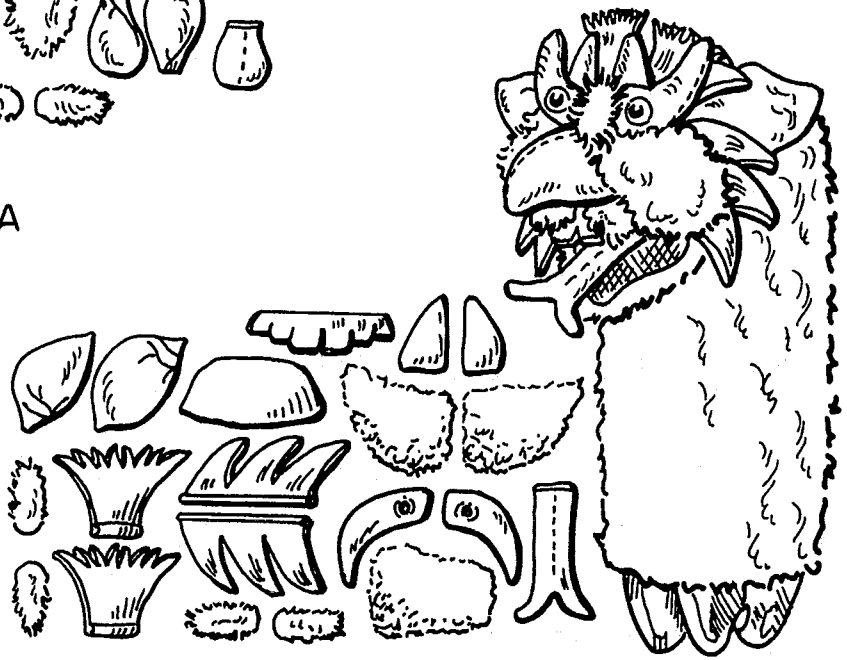
Figure 7D:
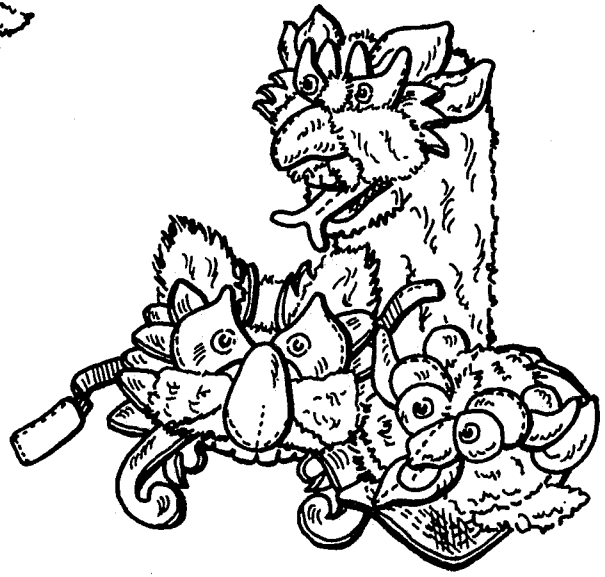
Figure 7C:
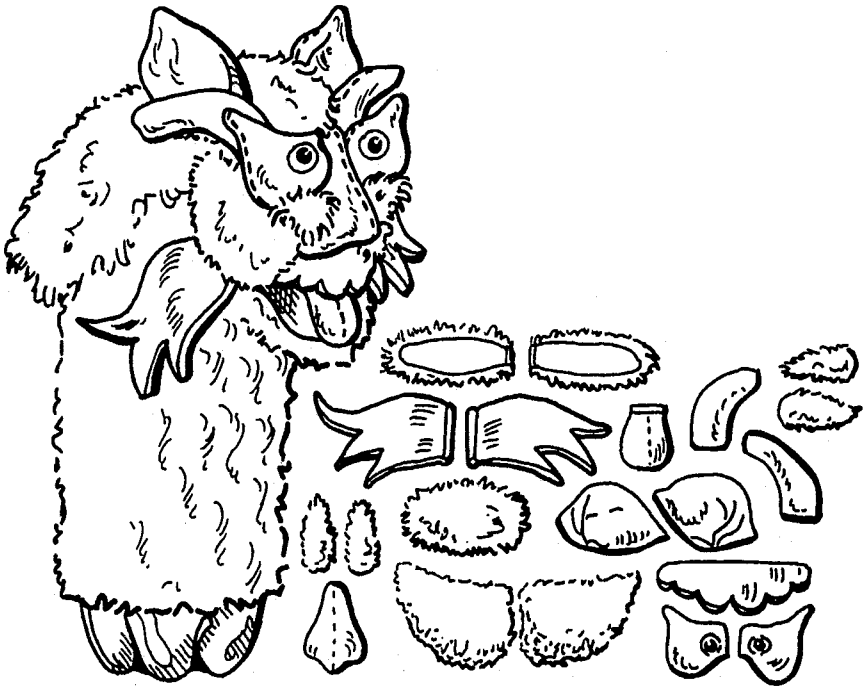

Another intra-changeable part is shown in FIGS. 5A through 5H, wherein two identical pieces are sewn or ultrasonically welded together with the "loop" fabric facing inwardly along the broken line (61) FIG. 5A. The part is then turned inside-out. The curved open edge (62) is then folded halfway over on itself and sewn or ultrasonically welded together FIG. 5B forming a transformable "ear". It then can be shaped into many different parts as identified in FIGS. 5C through FIGS. 5H and attached as noted above to the hat, mask, puppet or the like item.

Yet another intra-changeable part is shown in FIGS. 6A through 6J etc.

FIGS. 7A through 7D show a puppet with a number of facial elements which can be applied to the face, forehead and front scalp surface containing the "hook" fastener materials.

Figure 8:
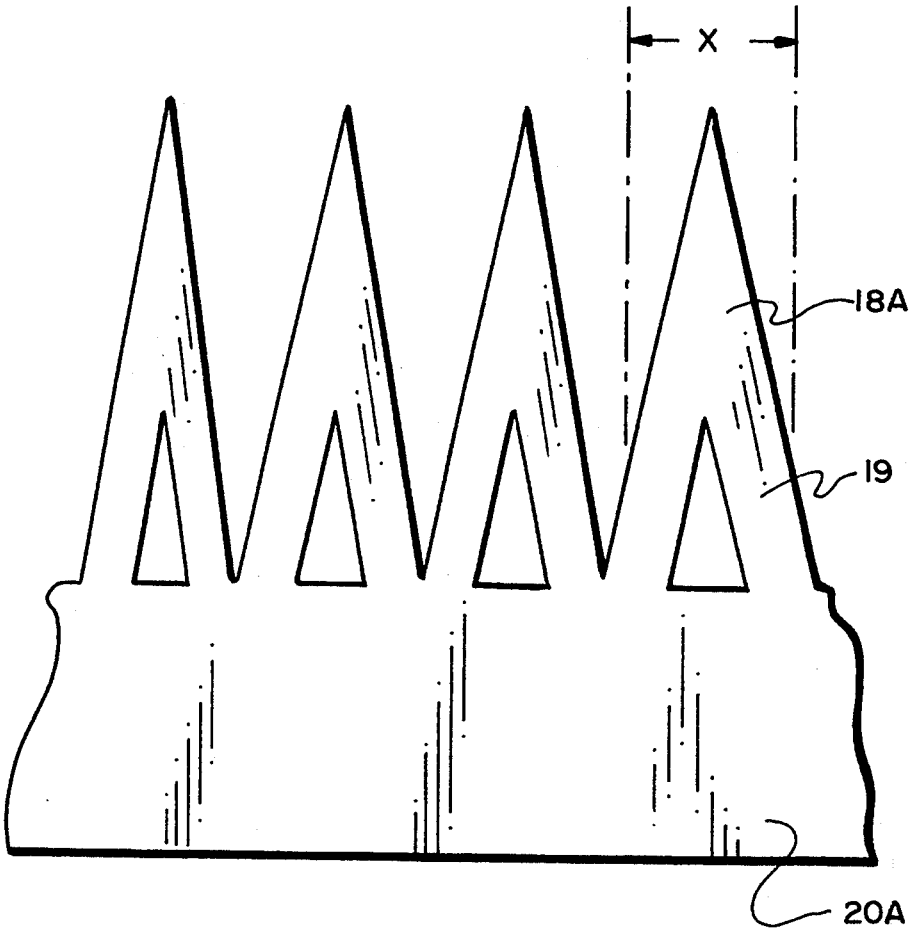
FIG. 8 shows another embodiment of a die cut sheet of the hook fastener material as it might apply to a ¼ sphere base.

FIG. 8 demonstrates the construction of a modified form of "hook" sheet (20A) having tapered portions (18A) which have one dimension "x" having no more than about 15 degrees of arc of the compound front skull section of the base support. Where the tapered portion (18A) is wider than the dimension "x", it is relieved by the cut-out portions (19).

While a number of forms of the invention have been described above, numerous other modifications, due to the intra-changeable and inter-changeable parts thereof, can be made without departing from the spirit of the invention. This allows for infinite variations of fanciful animal, human and monster critters to be created by the user's hand without repeating the same form twice.

We claim:

1. A toy comprising a base support on which fanciful animal, human or monster faces can be created by attaching facsimiles of discrete facial elements comprising an ear, nose, mouth or tongue to a "hook" fastening surface on said base support, said base support including a face and a scalp portion, and said toy comprising a plurality of discrete, removably attachable facsimiles of such facial elements, at least some of said facial elements each being made of a plurality of layers of material fastened to each other at the edges thereof, said layers being movable with respect to each other and in their normal condition being in contact with each other, said layers being freely separable from each other throughout most of their area so that they can be temporarily deformed into concave and convex surfaces representing at least two different facial elements, such as an ear or a nose, the outer surface of the temporarily deformable layers being formed of "loop" material which can be held in its deformed concave and convex positions by the hook fastening surface and being held by said hook surface in the appropriate position to represent said formed facial element.

2. The toy of claim 1 wherein said scalp portion of said base support has a compound curved surface made of a fabric support layer, and said fabric support surface having a predetermined radius of curvature, onto which an essentially non-extensible flexible "hook" fastening material, constituting a plurality of discrete "hook" portions of a "hook and loop" fastener system, is bonded to form a composite "hook" fastener support layer, each said discrete "hook" portion having at least one non-extensible section with one dimension no greater than about 15 degrees of arc of said compound curved surface.

3. The toy of claim 1 wherein said support includes a gaping mouth and one of said deformable facial elements can be formed into a tongue, said deformable tongue element being held in a given tongue shape by the joint action of the composite support layer and the bond between said "loop" fabric layer and said "hook" fastening surface.

4. The toy of claim 1 wherein the plurality of layers of material have generally curved edges, said layers being sewn or ultrasonically welded at said edges.

5. The toy of claim 3 wherein said base support also includes a fabric neck portion.

* * * * *

UNITED STATES PATENT AND TRADEMARK OFFICE

CERTIFICATE OF CORRECTION

PATENT NO. : 5,348,510

DATED : September 20, 1994

INVENTOR(S) : Paul DUPONT and Brian GROSVENOR

It is certified that error appears in the above-indentified patent and that said Letters Patent is hereby corrected as shown below:

On the title page, item: [73] "Hatsoff?" should be --Hatsoff!--

Signed and Sealed this

Seventh Day of March, 1995

*Attest:*

Bruce Lehman

BRUCE LEHMAN

*Attesting Officer*

*Commissioner of Patents and Trademarks*